US010914019B2

(12) United States Patent
Chang et al.

(10) Patent No.: US 10,914,019 B2
(45) Date of Patent: Feb. 9, 2021

(54) PLATING APPARATUS AND PLATING METHOD

(71) Applicant: EBARA CORPORATION, Tokyo (JP)

(72) Inventors: Shao Hua Chang, Tokyo (JP); Yasuyuki Masuda, Tokyo (JP); Jumpei Fujikata, Tokyo (JP); Masashi Shimoyama, Tokyo (JP); Tsutomu Nakada, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 13 days.

(21) Appl. No.: 16/174,103

(22) Filed: Oct. 29, 2018

(65) Prior Publication Data

US 2019/0127875 A1 May 2, 2019

(30) Foreign Application Priority Data

Oct. 31, 2017 (JP) ..... 2017-210618

(51) Int. Cl.
*C25D 21/10* (2006.01)
*C25D 17/00* (2006.01)

(52) U.S. Cl.
CPC ..... *C25D 21/10* (2013.01); *C25D 17/001* (2013.01)

(58) Field of Classification Search
None
See application file for complete search history.

(56) References Cited

U.S. PATENT DOCUMENTS 2,693,788 A * 11/1954 Spatz ..... B43M 99/004 211/69.1
7,671,712 B2 * 3/2010 Elliott ..... H01F 7/0236 335/209
2004/0262150 A1 12/2004 Yajima et al.
2009/0139871 A1 * 6/2009 Saito ..... C25D 21/12 205/148

(Continued)

FOREIGN PATENT DOCUMENTS

CN 2813528 Y 9/2006
CN 101451264 A 6/2009

(Continued)

OTHER PUBLICATIONS

Supermagnete FAQ-Frequently Asked Questions, available at https://www.supermagnete.de/eng/faq/What-is-the-difference-between-the-combination-magnet-magnet-and-magnet-iron, Sep. 2013 (date verified copy obtained from Wayback Machien at archive.org on May 29, 2020) (Year: 2013).*

*Primary Examiner* — Harry D Wilkins, III
(74) *Attorney, Agent, or Firm* — BakerHostetler

(57) ABSTRACT

A plating apparatus for plating a substrate is provided to reduce vibration of a paddle. The plating apparatus includes a plating bath configured to accommodate plating solution; a paddle that is arranged in the plating bath, and configured to move in a reciprocating direction along a surface of the substrate to stir the plating solution; a support member for supporting a first end portion of the paddle; a first magnet provided on the paddle; and a second magnet provided on the plating bath. The first magnet and the second magnet are configured to exert a magnetic force on each other so that a second end portion on an opposite side to the first end portion of the paddle is suppressed from vibrating in directions approaching and leaving the substrate while the paddle is moving.

5 Claims, 9 Drawing Sheets

(56) References Cited

U.S. PATENT DOCUMENTS

| | | | | |
|---|---|---|---|---|
| 2010/0295317 | A1* | 11/2010 | Mahawili | H02K 7/1869<br>290/55 |
| 2013/0001087 | A1* | 1/2013 | Asa | C25D 5/08<br>205/80 |

FOREIGN PATENT DOCUMENTS

| | | | | |
|---|---|---|---|---|
| CN | 102851721 | A | | 1/2013 |
| JP | 2013-011004 | A | * | 1/2013 |
| WO | WO 2004/009879 | A1 | | 1/2004 |

* cited by examiner

PLATING APPARATUS AND PLATING METHOD

CROSS-REFERENCE TO RELATED APPLICATION

This application is based upon and claims benefit of priority from Japanese Patent Application No. 2017-210618 filed on Oct. 31, 2017, the entire contents of which are incorporated herein by reference.

TECHNICAL FIELD

The present invention relates to a plating apparatus and a plating method.

BACKGROUND ART

An electroplating apparatus including a plating bath for storing plating solution therein, a substrate and an anode that are arranged so as to face each other inside the plating bath, and an adjusting plate arranged between the anode and the substrate is known as an electroplating apparatus adopting a so-called dipping system (see PTL 1, for example). The electroplating apparatus has a paddle for stirring the plating solution between the adjusting plate and the substrate. The paddle moves in a reciprocating direction along the surface of the substrate to stir the plating solution in the vicinity of the surface of the substrate.

In order to enhance the productivity of plating apparatuses, it has been recently required to shorten a plating time required for forming a plating film having a predetermined film thickness. In order to perform plating with a predetermined film thickness in a shorter time for a certain plating area, it is necessary to perform plating at a high plating speed by causing a higher current to flow, that is, it is necessary to perform plating at a high current density. When plating is performed at such a high current density, the paddle is moved at a high speed to promote supply of ions to the surface of the substrate, thereby enhancing the quality of the plating.

CITATION LIST

Patent Literature

PTL 1: International Publication No. WO 2004/009879

SUMMARY OF INVENTION

Technical Problem

It has been recently required to further increase the moving speed of the paddle. However, when the moving speed of the paddle is increased, resistance which the paddle suffers from the plating solution increases, and the vibration of the paddle intensifies. Specifically, vibration of a non-supported end portion of the paddle in directions approaching and leaving the substrate intensifies, and thus there is a risk that the paddle may come into contact with the substrate. Furthermore, when the resistance which the paddle suffers from the plating solution increases excessively, there is a risk that the paddle may be broken.

The present invention has been implemented in view of the foregoing problem, and has an object to reduce the vibration of the paddle.

Solution to Problem

According to an aspect of the present invention, a plating apparatus for plating a substrate is provided. The plating apparatus includes a plating bath configured to accommodate plating solution; a paddle that is arranged in the plating bath, and configured to move in a reciprocating direction along a surface of the substrate to stir the plating solution; a support member for supporting a first end portion of the paddle; a first magnet provided on the paddle; and a second magnet provided on the plating bath. The first magnet and the second magnet are configured to exert a magnetic force on each other so that a second end portion on an opposite side to the first end portion of the paddle is suppressed from vibrating in directions approaching and leaving the substrate while the paddle is moving.

According to another aspect of the present invention, a plating method for plating a substrate is provided. The plating method includes a step of accommodating a substrate and an anode in a plating bath; a step of supporting a first end portion of a paddle; a step of providing a first magnet to the paddle; a step of providing a second magnet to the plating bath; a step of moving the paddle in a reciprocating direction along a surface of the substrate to stir plating solution stored in the plating bath; and a step of exerting a magnetic force on the first magnet by the second magnet so that a second end portion on an opposite side to the first end portion of the paddle is suppressed from vibrating in directions approaching and leaving the substrate while the paddle moves.

DESCRIPTION OF EMBODIMENTS

Figure 1:
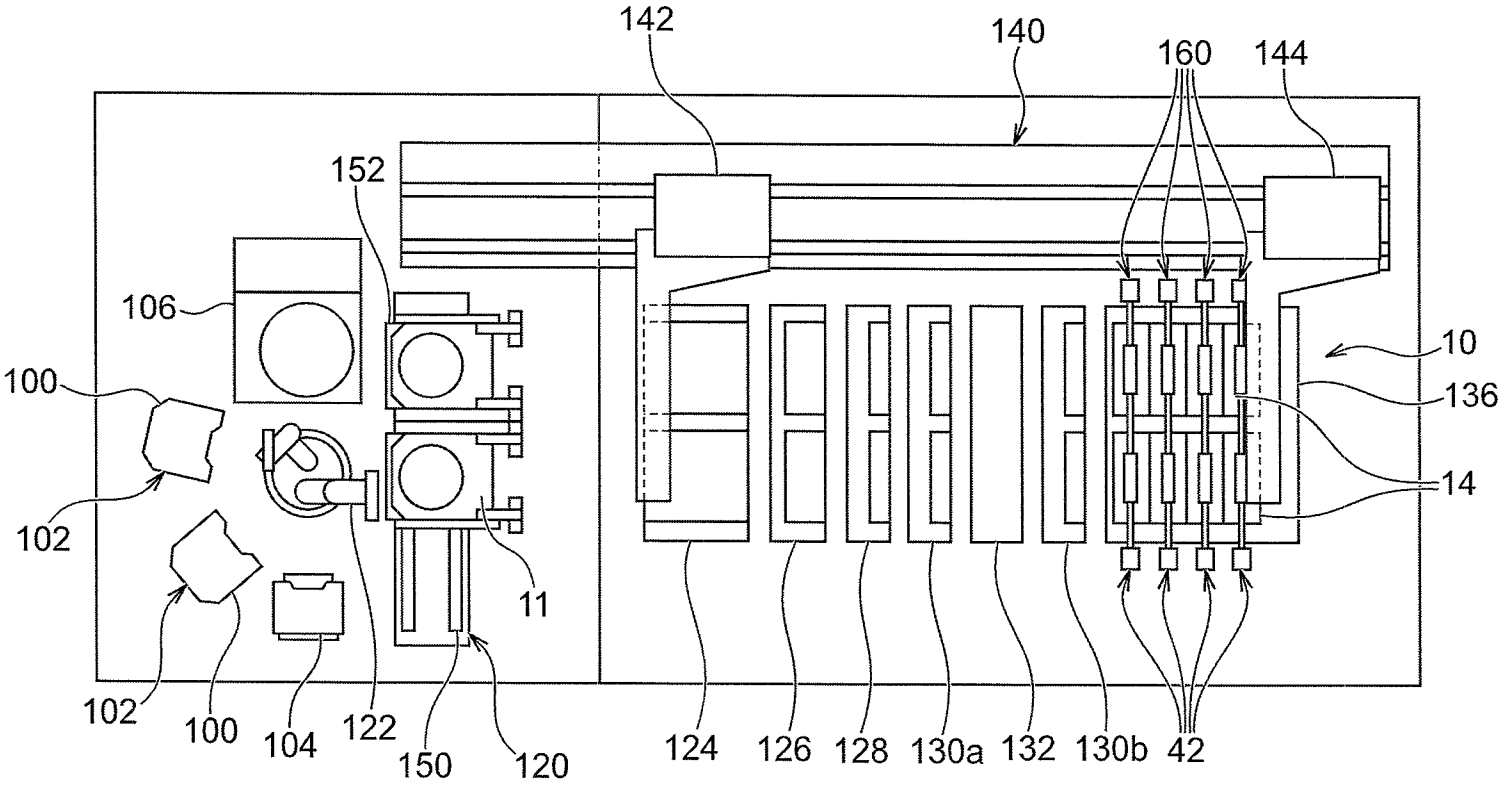
FIG. 1 is an overall arrangement diagram of a plating apparatus according to an embodiment.

Embodiments of the present invention will be described hereinafter with reference to the drawings. In the drawings described below, the same or corresponding constituent elements are represented by the same reference signs, and duplicate description is omitted.

FIG. 1 is an overall arrangement diagram of a plating apparatus according to the present embodiment. As shown in FIG. 1, the plating apparatus includes two cassette tables 102, an aligner 104 for aligning the positions of an orientation flat, a notch, etc. of a substrate in a predetermined direction, and a spin rinse dryer 106 for rotating the substrate at a high-speed after the plating processing to dry the plated substrate. The cassette table 102 mounts thereon a cassette 100 in which a substrate such as a semiconductor wafer is accommodated. A substrate mounting/demounting unit 120 is provided in the vicinity of the spin rinse dryer 106 in which a substrate holder 11 is carried to mount and demount a substrate. The substrate mounting/demounting unit 120 includes a flat plate-shaped carry plate 152 that is freely slidable in a lateral direction along rails 150. Two substrate holders 11 are horizontally carried side by side on the carry plate 152. After a substrate is delivered between one substrate holder 11 and a substrate transfer device 122, the carry plate 152 is slid in the lateral direction, and a substrate is delivered between the other substrate holder 11 and the substrate transfer device 122. The substrate transfer device 122 which includes a transfer robot and transfers substrates among the units 100, 104, 106 and 120 is arranged at the center of the units 100, 104, 106 and 120.

The plating apparatus further includes a stocker 124, a pre-wet bath 126, a pre-soak bath 128, a first cleaning bath 130*a*, a blow bath 132, a second cleaning bath 130*b*, and a plating unit 10. The substrate holders 11 are stocked and temporarily placed in the stocker 124. The substrate is immersed in pure water in the pre-wet bath 126. An oxide film on the surface of a conductive layer such as a seed layer formed on the surface of the substrate is removed by etching in the pre-soak bath 128. The substrate after the pre-soak is cleaned with cleaning liquid (pure water or the like) together with the substrate holder 11 in the first cleaning bath 130*a*. Draining of the substrate after cleaning is performed in the blow bath 132. The substrate after the plating is cleaned with the cleaning liquid together with the substrate holder 11 in the second cleaning bath 130*b*. The substrate mounting/demounting unit 120, the stocker 124, the pre-wet bath 126, the pre-soak bath 128, the first cleaning bath 130 *a*, the blow bath 132, the second cleaning bath 130*b*, and the plating unit 10 are arranged in this order.

The plating unit 10 is configured, for example, so that an overflow bath 136 surrounds the outer peripheries of plural adjacent plating baths 14. Each plating bath 14 is configured so that it accommodates one substrate therein and the substrate is immersed in plating solution held therein to perform plating such as copper plating on the surface of the substrate.

The plating apparatus includes a substrate holder transporting device 140 which adopts, for example, a linear motor system and is located at a side of each of these units to transport the substrate holders 11 with the substrate among these units. The substrate holder transporting device 140 includes a first transporter 142 and a second transporter 144. The first transporter 142 is configured so as to transport substrates among the substrate mounting/demounting unit 120, the stocker 124, the pre-wet bath 126, the pre-soak bath 128, the first cleaning bath 130*a*, and the blow bath 132. The second transporter 144 is configured so as to transport substrates among the first cleaning bath 130*a*, the second cleaning bath 130*b*, the blow bath 132, and the plating unit 10. The plating apparatus may include only the first transporter 142 without including the second transporter 144.

On both sides of the overflow bath 136 are arranged paddle driving units 42 and paddle followers 160 that drive paddles 16 (see FIG. 3) as stirring rods each of which is placed inside each plating bath 14 to stir the plating solution in the plating bath 14.

Figure 2:
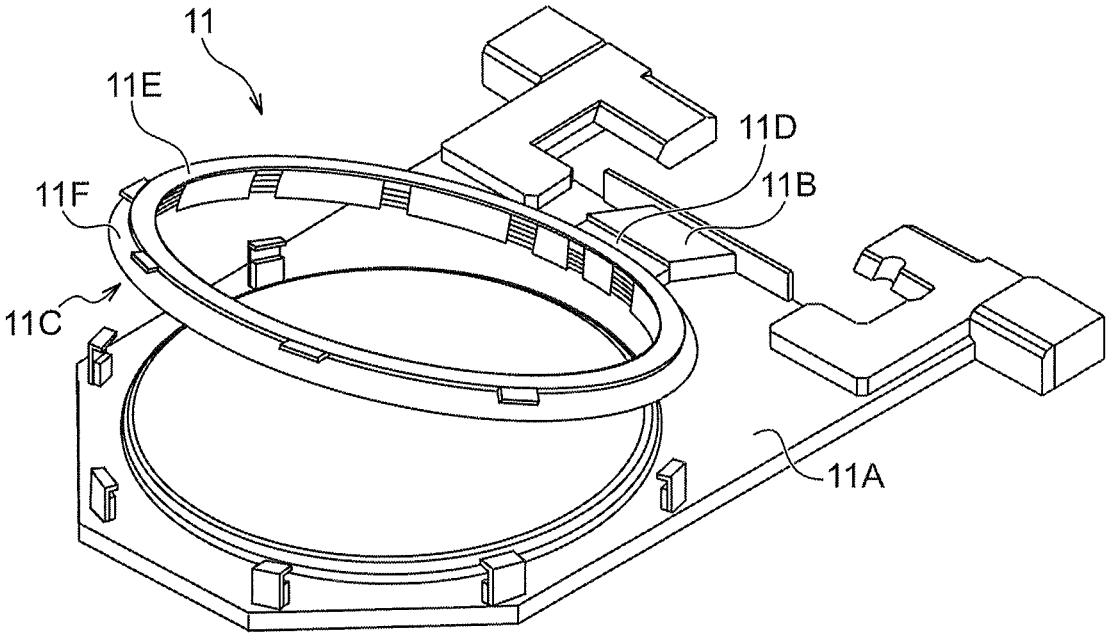
FIG. 2 is a schematically perspective view showing a substrate holder shown in FIG. 1.

FIG. 2 is a schematic perspective view of the substrate holder 11 shown in FIG. 1. As shown in FIG. 2, the substrate holder 11 includes a first holding member 11A made of, for example, vinyl chloride and having a rectangular flat plate shape, and a second holding member 11C that is attached to the first holding member 11A so as to be freely opened and closed via a hinge portion 11B. The second holding member 11C has a base portion 11D connected to the hinge portion 11B, a press ring 11F for pressing the substrate against the first holding member 11A, and a ring-shaped seal holder 11E. The seal holder 11E is configured so as to be slidable with respect to the press ring 11F. The seal holder 11E is made of, for example, vinyl chloride, thereby improving slippage with the press ring 11F. In the present embodiment, the plating apparatus will be described as one for processing a circular substrate such as a wafer. However, the plating apparatus is not limited to this style, and the plating apparatus also may process a rectangular substrate.

Figure 3:
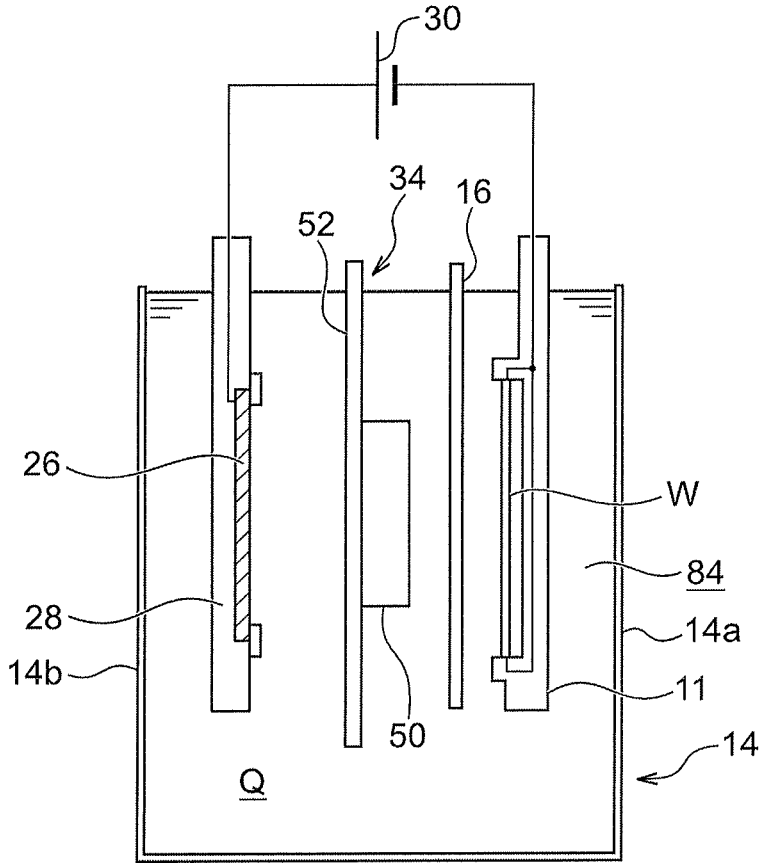
FIG. 3 is a schematic longitudinal-sectional view showing one plating bath of a plating unit shown in FIG. 1.

FIG. 3 is a schematic longitudinal-sectional view showing one plating bath 14 of the plating unit 10 shown in FIG. 1. In FIG. 3, the overflow bath 136 is omitted. The plating bath 14 holds plating solution Q therein and is configured so that the plating solution Q circulates between the plating bath 14 and the overflow bath 136.

The substrate holder 11 that detachably holds a substrate W is accommodated in the plating bath 14. The substrate holder 11 is placed in the plating bath 14 so that the substrate W is immersed in the plating solution Q under a vertical state. An anode 26 held by an anode holder 28 is arranged at a position facing the substrate W in the plating bath 14. For example, phosphorus-containing copper can be used for the anode 26. The substrate W and the anode 26 are electrically connected to each other via a plating power source 30, and current is caused to flow between the substrate W and the anode 26, thereby forming a plating film (copper film) on the surface of the substrate W. The plating bath 14 has a first side wall 14*a* and a second side wall 14*b*, the first side wall 14*a* being positioned on the side of the substrate W, and the second side wall 14*b* being positioned on the side of the anode 26 when the substrate W and the anode 26 are arranged so as to face each other.

The paddle 16 that reciprocates in parallel to the surface of the substrate W and stirs the plating solution Q is arranged between the substrate W and the anode 26. In the present embodiment, the paddle 16 is configured so as to reciprocate in a substantially horizontal direction, but the paddle 16 is not limited to this configuration. The paddle 16 may be configured so as to reciprocate in a vertical direction. By stirring the plating solution Q with the paddle 16, copper ions can be uniformly supplied onto the surface of the substrate W. Furthermore, an adjusting plate (regulation plate) 34 made of a dielectric material for making the potential distribution over the entire surface of the substrate W more uniform is arranged between the paddle 16 and the anode 26. The adjusting plate 34 includes a plate-like main body portion 52 having an opening and a tubular portion 50 attached along the opening of the main body portion 52. The potential distribution between the anode 26 and the substrate W is adjusted according to the size and shape of the opening of the adjusting plate 34.

Figure 4:
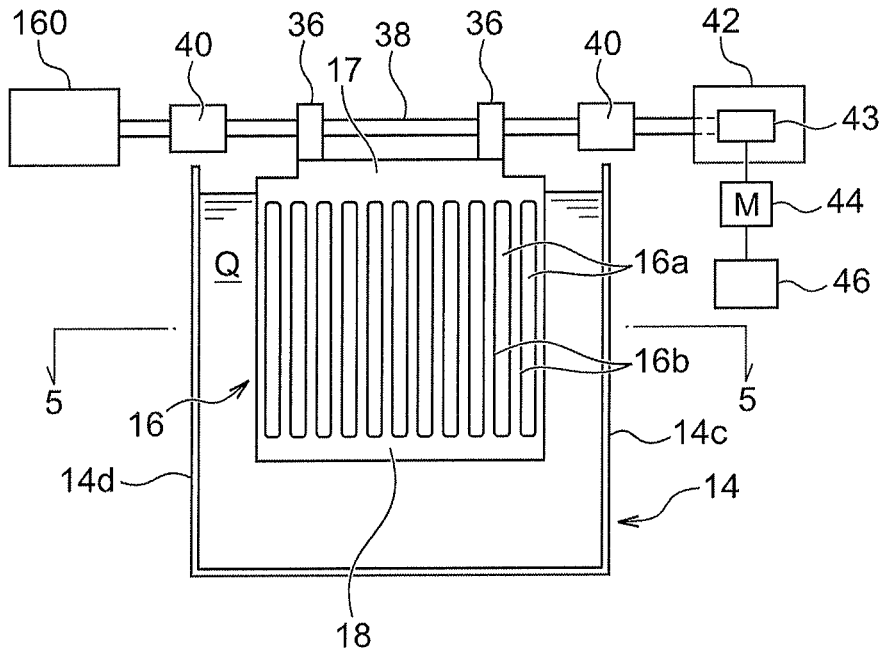
FIG. 4 is a front view showing the plating bath and a paddle driving mechanism.

FIG. 4 is a front view showing the plating bath 14 and the driving mechanism for the paddle 16. As shown in FIG. 4, the paddle 16 is constituted by a rectangular plate-shaped member as a whole, and has plural elongated holes 16*a* in parallel, thereby having plural grid portions 16*b* extending in the vertical direction. The paddle 16 may be formed of a material obtained by coating a Teflon (registered trademark) on a non-magnetic material such as titanium, or a material such as resin material which is not affected by magnetic force.

It is preferable to determine the width and the number of the elongated holes 16*a* such that the grid portions 16*b* are as narrow as possible while having required rigidity so that the grid portions 16*b* efficiently stir the plating solution and the plating solution efficiently passes through the elongated holes 16*a*.

An upper end portion 17 (corresponding to an example of a first end portion) of the paddle 16 is supported by a shaft 38 (corresponding to an example of a support member) extending in a substantially horizontal direction via a clamp 36 fixed to the upper end portion 17 of the paddle 16. The shaft 38 is held by a shaft holding portion 40 so as to be slidable in a substantially horizontal direction. An end portion of the shaft 38 is connected to a paddle driving unit 42 and a paddle follower 160 that cause the paddle 16 to linearly reciprocate in the substantially horizontal direction. The paddle driving unit 42 converts rotation of a motor 44 into linear reciprocating motion of the shaft 38 by a motion conversion mechanism 43 such as a crank mechanism or a Scotch yoke mechanism. In this example, a controller 46 for controlling the rotation speed and phase of the motor 44 of the paddle driving unit 42 is provided. A lower end portion 18 (corresponding to an example of a second end portion) of the paddle 16 constitutes a free end.

The plating bath 14 has a third side wall 14*c* and a fourth side wall 14*d* that connect the first side wall 14*a* and the second side wall 14*b* shown in FIG. 3. FIG. 4 shows only one plating bath 14, but two or more plating baths 14 may be arranged to be adjacent to each other in the lateral direction as shown in FIG. 1. In that case, two or more paddles 16 are fixed to the shaft 38 so that the two or more paddles 16 reciprocate by one paddle driving unit 42 and a paddle follower 160.

Figure 5A:
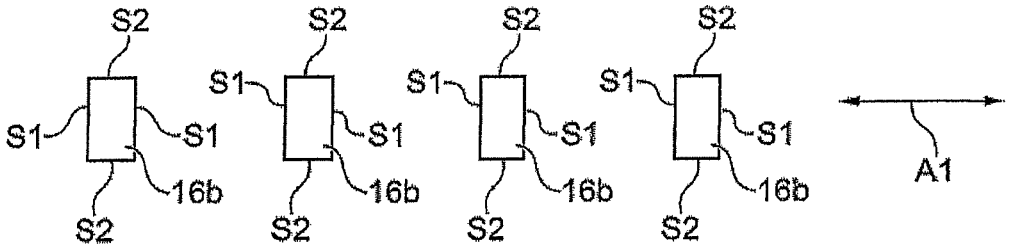
FIG. 5A is a cross-sectional view showing an example of the shape of a grid portion of a paddle in an arrow view 5-5 shown in FIG. 4.

FIGS. 5A to 5D are cross-sectional views showing examples of the shapes of the grid portions 16*b* of the paddle 16 in arrow views 5-5 shown in FIG. 4. Only four of the plural grid portions 16*b* are shown in FIGS. 5A to 5D. Furthermore, in FIGS. 5A to 5D, the reciprocating direction of the paddle 16 is represented by an arrow A1. In the present embodiment, any cross-sectional shape containing the cross-sectional shapes shown in FIGS. 5A to 5D can be adopted as the cross-sectional shapes of the grid portions 16*b* of the paddle 16. In an example shown in FIG. 5A, the cross-sectional shape of the grid portions 16*b* is rectangular. Specifically, the grid portion 16*b* of the paddle 16 has surfaces S1 which are perpendicular to the reciprocating direction of the paddle 16 and surfaces S2 which are parallel to the reciprocating direction of the paddle 16. Furthermore, the grid portion 16*b* in FIG. 5A is oriented so as to be symmetrical with respect to the vertical direction in FIG. 5A.

Figure 5B:
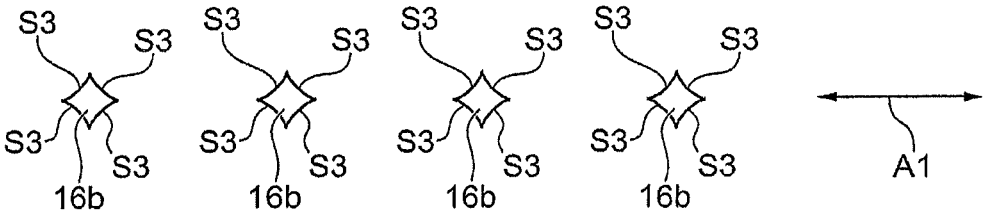
FIG. 5B is a cross-sectional view showing an example of the shape of the grid portion of the paddle in the arrow view 5-5 shown in FIG. 4.

In an example shown in FIG. 5B, the cross-sectional shape of the grid portion 16*b* is a stellate shape which has four vertexes and also has curved surfaces connecting these vertexes. The grid portion 16*b* has surfaces S3 that are neither perpendicular nor parallel to the reciprocating direction of the paddle 16. Furthermore, the grid portions 16*b* in FIG. 5B are arranged while oriented so as to be symmetrical with respect to the vertical direction in FIG. 5B. In an example shown in FIG. 5C, the cross-sectional shape of the grid portions 16*b* is a triangle, and the grid portions 16*b* are arranged so that the directions thereof are alternately changed by 180°. These grid portions 16*b* each have surfaces S4 which are neither perpendicular nor parallel to the reciprocating direction of the paddle 16 and a surface S5 perpendicular to the reciprocating direction. Furthermore, the grid portions 16*b* of FIG. 5C are arranged while oriented so as to be symmetrical with respect to the vertical direction in FIG. 5C.

Figure 5C:
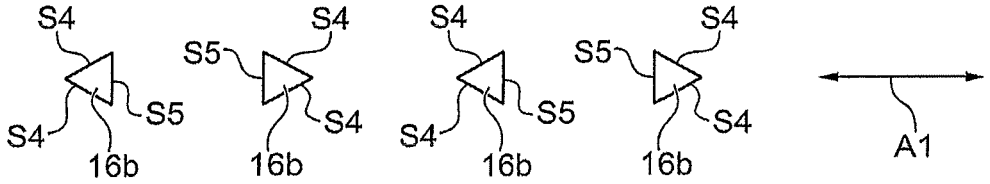
FIG. 5C is a cross-sectional view showing an example of the shape of the grid portion of the paddle in the arrow view 5-5 shown in FIG. 4.
Figure 5D:
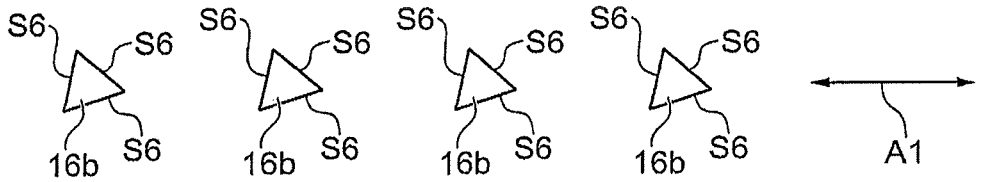
FIG. 5D is a cross-sectional view showing an example of the shape of the grid portion of the paddle in the arrow view 5-5 shown in FIG. 4.

In an example shown in FIG. 5D, the cross-sectional shape of the grid portion 16*b* is a triangle like the example shown in FIG. 5C. The grid portion 16*b* has surfaces S6 that are neither perpendicular nor parallel to the reciprocating direction of the paddle 16. The directions of the grid portions 16*b* are all the same. On the other hand, the grid portions 16*b* of FIG. 5D are arranged while oriented so as to be asymmetrical with respect to the vertical direction in FIG. 5D unlike the grid portions 16*b* of FIGS. 5A to 5C.

When the paddles 16 in FIGS. 5B to 5D are reciprocated in the direction of arrow A1 to stir the plating solution, the plating solution is extruded to the surface of the substrate along the surfaces S3, S4 and S6 of the grid portions 16*b* because each of the surfaces S3, S4 and S6 is neither perpendicular nor parallel to the reciprocating direction of the paddles 16. Accordingly, the paddles 16 of FIGS. 5B to 5D can extrude more plating solution to the surface of the substrate than the paddle 16 of FIG. 5A, and efficiently supply metal ions in the plating solution to the substrate. On the other hand, when the paddles 16 of FIGS. 5B to 5D are reciprocated, a larger vortex of the plating solution than the paddle 16 of FIG. 5A is generated. Therefore, when the paddles 16 of FIGS. 5B to 5D are reciprocated, each of the paddles 16 comes into contact with this vortex and thus the reciprocating path of the paddle 16 is changed, so that the lower end portion 18 (see FIG. 4) of the paddle 16 easily vibrates in directions approaching and leaving the substrate W (that is, in the vertical direction in the drawings).

Since the grid portion 16*b* in FIG. 5D has a triangular cross-section that is asymmetrical with respect to the vertical direction in FIG. 5D, the amount of the plating solution Q which can be extruded when the paddle 16 is reciprocated differs between the upward direction and the downward direction. Accordingly, when the substrate W is arranged in a direction in which the plating solution Q to be extruded is larger, a larger amount of the plating solution Q can be extruded to the surface of the substrate W than that when the grid portions 16*b* are arranged to be symmetrical with respect to the vertical direction in the drawing. However, as in the case of the grid portion 16*b* of FIG. 5D, with respect to the paddle 16 having a cross-section asymmetric with respect to the vertical direction in the drawings, the amount of plating solution Q that can be extruded differs between the upward direction and the downward direction, so that during driving of the paddle 16, biased force is applied to one side of the upper and lower sides by the plating solution Q.

When the paddle 16 is reciprocated, a vibration of the paddle 16 in directions approaching and leaving the substrate W occur due to the contact with a vortex. Particularly, when the paddle 16 has a grid portion 16*b* having a surface which is neither perpendicular nor parallel to the reciprocating direction of the paddles 16 as shown in FIGS. 5 B to 5 D, such a vortex becomes large, and particularly the vibration of the paddle 16 causes a problem. Therefore, in the present embodiment, in order to reduce vibration of the paddle 16, magnets are provided on the paddle 16 and the plating bath 14.

Figure 6:
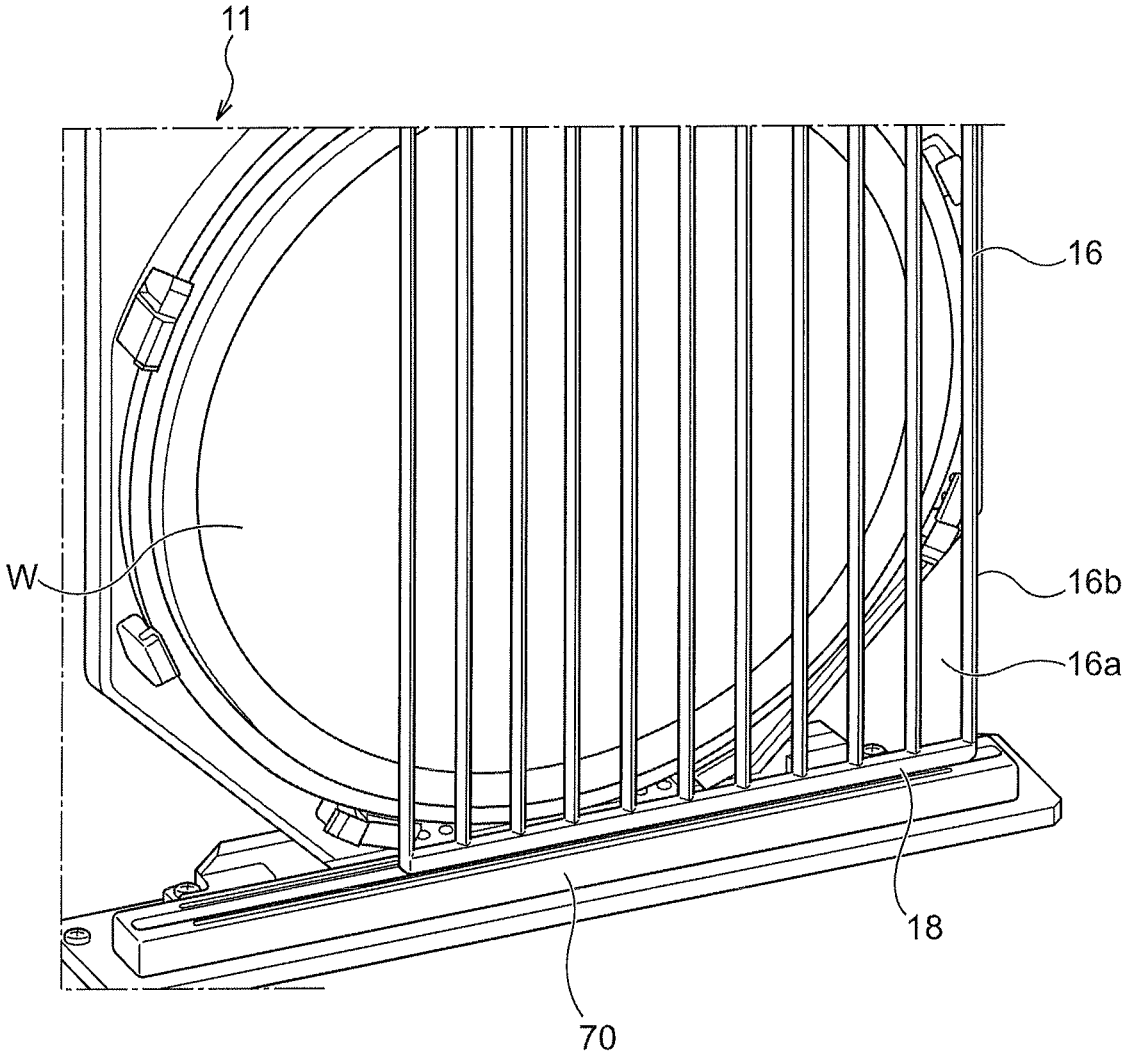
FIG. 6 is a perspective view showing the vicinity of a bottom portion of a plating bath according to the present embodiment.
Figure 7:
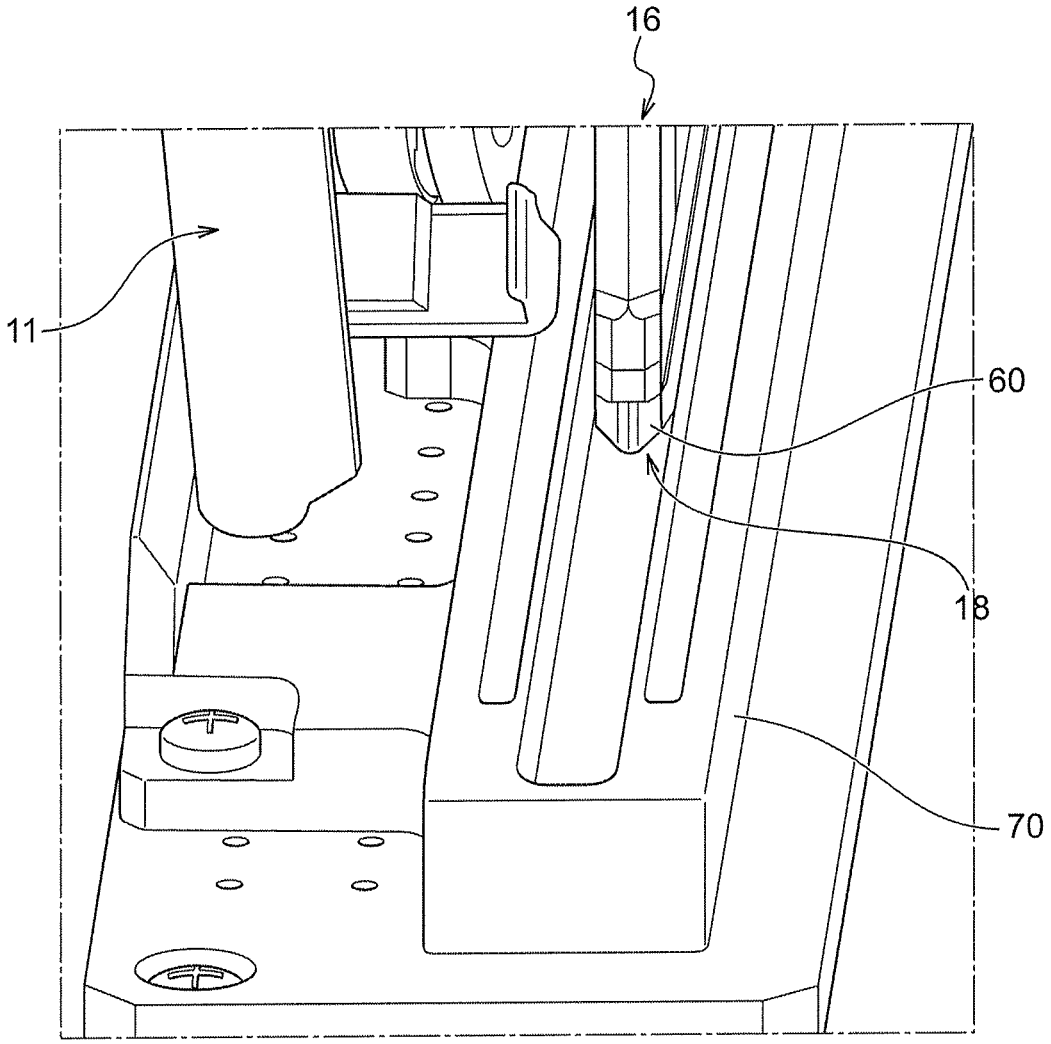
FIG. 7 is an enlarged perspective view showing the vicinity of a lower end portion of the paddle according to the present embodiment.

FIG. 6 is a perspective view showing the vicinity of the bottom portion of the plating bath 14 according to the present embodiment. FIG. 7 is an enlarged perspective view showing the vicinity of the lower end portion 18 of the paddle 16 according to the present embodiment. As shown in FIG. 6, the paddle 16 and the substrate holder 11 are vertically accommodated in the plating bath 14. A guide magnet 70 is arranged in the vicinity of the lower end portion 18 of the paddle 16. The guide magnet 70 is fixed to the bottom portion of the plating bath 14 along the reciprocating direction of the paddle 16. As shown in FIG. 7, a paddle magnet 60 is provided at the lower end portion 18 of the paddle 16. FIG. 7 shows a state where the paddle magnet 60 is covered with, for example, a resin cover in order to avoid direct contact of the paddle magnet 60 with the plating solution. In the present embodiment, the paddle magnet 60 and the guide magnet 70 exert magnetic force on each other so as to suppress the lower end portion 18 of the paddle 16 from vibrating in the directions approaching and leaving the substrate W while the paddle moves.

Figure 8:
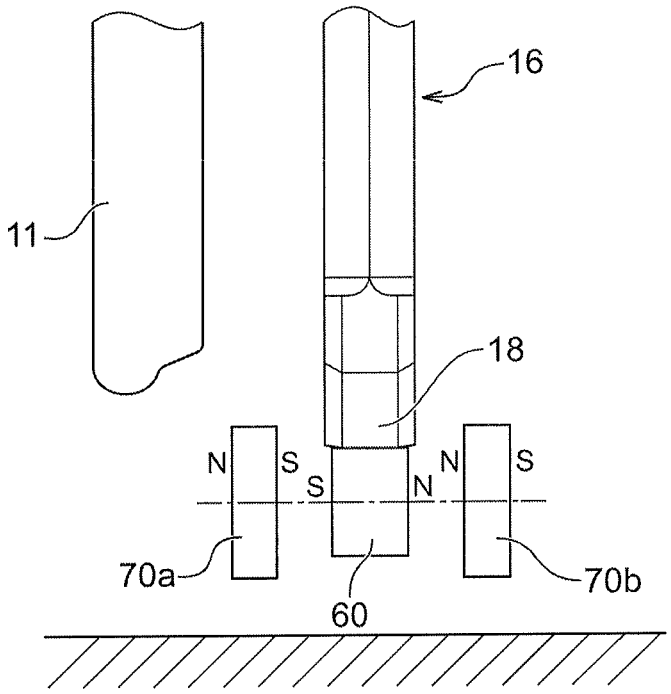
FIG. 8 is a schematic diagram showing an example of the arrangement relationship and polarity relationship between a paddle magnet and a guide magnet.

How the paddle magnet 60 and the guide magnet 70 mutually exert magnetic force on each other will be described in detail. FIG. 8 is a schematic diagram showing an example of the arrangement relationship and polarity relationship between the paddle magnet 60 and the guide magnet 70. In the example shown in FIG. 8, the paddle magnet 60 is attached to the lower end portion 18 so that the poles of the magnets are arranged in the thickness direction of the paddle 16. Furthermore, in this example, the guide magnet 70 has a substrate-side magnet 70*a* arranged on a substrate holder 11 side (substrate side) of the paddle magnet 60 and an opposite-side magnet 70*b* arranged on the opposite side thereof. It may be also said that the opposite-side magnet 70*b* is arranged on an anode 26 (see FIG. 3) side of the paddle magnet 60. As shown in FIG. 8, the paddle magnet 60 is arranged so as to be sandwiched between the substrate-side magnet 70*a* and the opposite-side magnet 70*b* of the guide magnet 70.

In the example shown in FIG. 8, the paddle magnet 60 is arranged while oriented so that the S pole thereof faces the substrate holder 11 side and the N pole thereof faces the opposite side. Also, the substrate-side magnet 70*a* are arranged while oriented so that the S pole of the substrate-side magnet 70*a* faces the paddle magnet 60, and the opposite-side magnet 70*b* are arranged while oriented so that the N pole of the opposite-side magnet 70*b* faces the paddle magnet 60. That is, the substrate-side magnet 70*a* and the opposite-side magnet 70*b* are arranged so as to exert magnetic repulsive forces on the paddle magnet 60, respectively.

As shown in FIG. 8, the side surface of the paddle magnet 60 receives magnetic repulsive forces from each of the substrate-side magnet 70*a* and the opposite-side magnet 70*b*. As a result, the magnetic forces received by the paddle magnet 60 from the substrate-side magnet 70*a* and the opposite-side magnet 70*b* are balanced with each other, so that the lower end portion 18 of the paddle 16 is suppressed from vibrating in the directions approaching and leaving the substrate W (in the right-and-left direction in FIG. 8). It is preferable that the magnetic forces of the substrate-side magnet 70*a* and the opposite-side magnet 70*b* are substantially the same level. In this case, the magnetic forces are balance with each other under a state where the lower end portion 18 of the paddle 16 face a substantially vertical direction. However, even when there is a difference in magnitude between the magnetic forces of the substrate-side magnet 70*a* and the opposite-side magnet 70*b*, the vibration of the lower end portion 18 is still suppressed because the magnetic forces are balanced with each other under a state where the lower end portion 18 of the paddle 16 is curved to either the left side or the right side in FIG. 8.

Furthermore, as shown in FIG. 8, it is preferable that a center portion in the vertical direction of the paddle magnet 60 and a center portion in the vertical direction between the substrate-side magnet 70*a* and the opposite-side magnet 70*b* are located at substantially the same height. As a result, an occurrence of a force for pushing up or down the paddle magnet 60 can be suppressed due to the magnetic forces of the substrate-side magnet 70*a* and the opposite-side magnet 70*b*.

Figure 9:
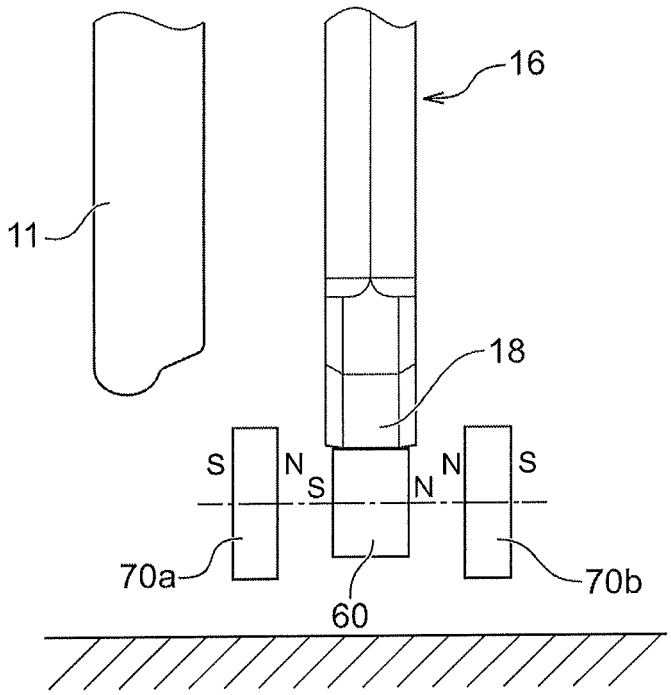
FIG. 9 is a schematic diagram showing another example of the arrangement relationship and polarity relationship between the paddle magnet and the guide magnet.

FIG. 9 is a schematic diagram showing another example of the arrangement relationship and polarity relationship between the paddle magnet 60 and the guide magnet 70. The example shown in FIG. 9 differs from the example shown in FIG. 8 only in the direction of the polarity of the substrate-side magnet 70*a*. That is, in the example shown in FIG. 9, the N pole of the substrate-side magnet 70*a* is arranged so as to face the paddle magnet 60. Accordingly, the substrate-side magnet 70*a* is arranged so as to exert a magnetic force attracting the paddle magnet 60 on the paddle magnet 60, and the opposite-side magnet 70*b* is arranged so as to exert a magnetic force repelling to the paddle magnet 60. In this case, the lower end portion 18 of the paddle 16 is urged in the direction approaching the substrate W (the leftward direction in FIG. 9), and the paddle magnet 60 may stick to the substrate-side magnet 70*a*.

The example shown in FIG. 9 is suitable for a case where a biased force is applied to one side in the width direction of the paddle 16 (in the vertical direction in FIG. 5D) during driving of the paddle 16 as in the case of the grid portion 16*b* of the paddle 16 shown in FIG. 5D. That is, in the example shown in FIG. 9, when the lower end portion 18 of the paddle 16 receives a reaction force in the left direction in FIG. 9 from the extruded plating solution due to the cross-sectional shape of the grid portion 16*b* during the driving of the paddle 16, the reaction force received from the plating solution is balanced with the magnetic force, so that the lower end portion 18 of the paddle 16 is oriented in the substantially vertical direction and thus the vibration can be suppressed.

In the example shown in FIG. 9, the direction of the polarity of the substrate-side magnet 70*a* is set to be opposite to that of the example shown in FIG. 8, but the present embodiment is not limited to this style. The direction of the polarity of the opposite-side magnet 70*b* may be set to be opposite to that of the example shown in FIG. 8. In this case, the opposite-side magnet 70*b* exerts a magnetic force attracting the paddle magnet 60 on the paddle magnet 60, and the substrate-side magnet 70*a* exerts a repelling magnetic force on the paddle magnet 60. Accordingly, the lower end portion 18 of the paddle 16 is urged in a direction leaving the substrate W. In the example shown in FIG. 9, the substrate-side magnet 70*a* and the opposite-side magnet 70*b* are provided as the guide magnet 70. However, only any one of the substrate-side magnet 70*a* and the opposite-side magnet 70*b* may be used as the guide magnet 70. In that case, either the substrate-side magnet 70*a* or the opposite-side magnet 70*b* can exert a repulsing or attracting magnetic force on the paddle magnet 60.

Figure 10:
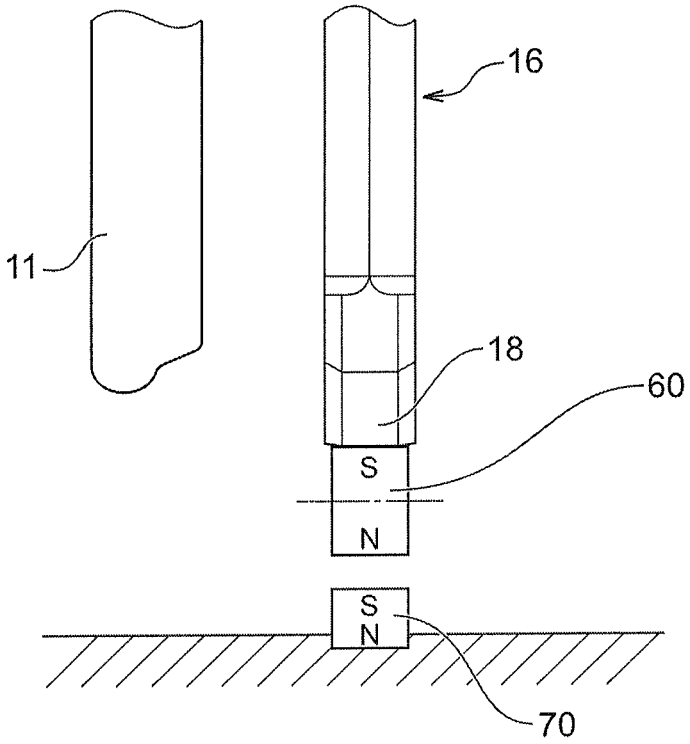
FIG. 10 is a schematic diagram showing another example of the arrangement relationship and polarity relationship between the paddle magnet and the guide magnet.

FIG. 10 is a schematic diagram showing another example of the arrangement relationship and polarity relationship between the paddle magnet 60 and the guide magnet 70. In the example shown in FIG. 10, the paddle magnet 60 is attached to the lower end portion 18 so that the poles of the magnets are arranged in the extending direction (vertical direction) of the paddle 16. Furthermore, in this example, the guide magnet 70 is arranged at a position facing the lower end portion 18 in the extending direction of the paddle 16 (vertical direction).

Furthermore, in the example shown in FIG. 10, the paddle magnet 60 is arranged while oriented so that the S pole faces the lower end portion 18 side (upper side) and the N pole faces the opposite side (lower side). Also, the guide magnet 70 is arranged while oriented so as to exert a magnetic force attracting the paddle magnet 60 on the paddle magnet 60.

In the example shown in FIG. 10, the paddle magnet 60 receives a magnetic force from the guide magnet 70 so that a vertically downward force acts. As a result, during reciprocation of the paddle 16, a vertically downward pulling force acts on the lower end portion 18 of the paddle 16, so that the lower end portion 18 of the paddle 16 is suppressed from vibrating in directions approaching and leaving the substrate W (in the right-and-left direction in FIG. 10). At this time, a vertically downward force also acts on the shaft 38 and the like (see FIG. 4) that support the paddle 16, and thus it is necessary that the shaft 38 and the like are designed so as to withstand the force. In the example shown in FIG. 10, the number of guide magnets 70 can be reduced as compared with the examples shown in FIGS. 8 and 9.

Next, a plating method in the plating apparatus according to the present embodiment will be described. First, as shown in FIG. 3, the substrate W and the anode 26 are accommodated in the plating bath 14. Furthermore, as shown in FIG. 4, the upper end portion 17 of the paddle 16 is fixed to the shaft 38 via the clamp 36. Furthermore, as shown in FIGS. 6 and 7, the paddle magnet 60 is provided on the lower end portion 18 of the paddle 16, and the guide magnet 70 is provided on the plating bath 14. Specifically, as shown in FIGS. 8 and 9, the substrate-side magnet 70*a* is arranged on the substrate W side of the paddle magnet 60, and the opposite-side magnet 70*b* is arranged on the opposite side thereof, whereby the paddle magnet 60 can be sandwiched by the magnet 70*a* and the opposite-side magnet 70*b*. In this case, as shown in FIG. 8, the substrate-side magnet 70*a* and the opposite-side magnet 70*b* may be arranged so that each of the magnets 70*a* and 70*b* exerts a repulsive magnetic force on the paddle magnet 60, or as shown in FIG. 9, the substrate-side magnet 70*a* and the opposite-side magnet 70*b* may be arranged so that any one of the substrate-side magnet 70*a* and the opposite-side magnet 70*b* exerts a repulsive force on the paddle magnet 60 while the other magnet of the substrate-side magnet 70*a* and the opposite-side magnet 70*b* exerts a magnetic force attracting the paddle magnet 60 on the paddle magnet 60. Alternatively, as shown in FIG. 10, the guide magnet 70 may be arranged so as to face the lower end portion 18 of the paddle 16 in the extending direction of the paddle 16 so that a magnetic force attracting the paddle magnet 60 is exerted on the paddle magnet 60.

When plating is performed on the substrate W, the paddle 16 is moved in the reciprocating direction along the surface of the substrate W to stir the plating solution Q. While the paddle 16 is moving, the paddle magnet 60 and the guide magnet 70 can suppress the lower end portion 18 of the paddle 16 from vibrating in directions approaching and leaving the substrate.

As described above, the plating apparatus according to the present embodiment can suppress vibration of the lower end portion 18 of the paddle 16 when the paddle 16 reciprocates because the paddle magnet 60 is provided on the paddle 16 and the guide magnet 70 is provided on the plating bath 14. In addition, it is also possible to prevent the paddle 16 from being broken. Furthermore, in the present embodiment, it is unnecessary to use, for example, mechanical means such as a guide rail or the like in order to suppress the vibration of the lower end portion 18 of the paddle 16. Accordingly, in the plating apparatus of the present embodiment, it is possible to prevent occurrence of particles caused by the mechanical means as described above, so that the manufacturing cost can be greatly reduced as compared with a case where mechanical means such as a guide rail is used.

The embodiment of the present invention has been described above. The embodiment of the invention described above is to facilitate the understanding of the present invention, and does not limit the present invention. The present invention can be changed and improved without departing from the subject matter of the invention, and it is needless to say that equivalents of the embodiment are included in the present invention. In addition, it is possible to arbitrarily combine or omit the respective constituent elements described in Claims and the specification in a range where at least a part of the above-mentioned problem can be solved or a range where at least a part of the effect is exhibited.

Some of aspects disclosed in the present specification will be described below.

According to a first aspect, a plating apparatus for plating a substrate is provided. The plating apparatus includes a plating bath configured to accommodate plating solution; a paddle that is arranged in the plating bath, and configured to move in a reciprocating direction along a surface of the substrate to stir the plating solution; a support member for supporting a first end portion of the paddle; a first magnet provided on the paddle; and a second magnet provided on the plating bath. The first magnet and the second magnet are configured to exert a magnetic force on each other so that a second end portion on an opposite side to the first end portion of the paddle is suppressed from vibrating in directions approaching and leaving the substrate while the paddle is moving.

According to a second aspect, in the plating apparatus according to the first aspect, the first magnet is provided on the second end portion of the paddle.

According to a third aspect, in the plating apparatus according to the first or second aspect, the second magnet includes a substrate-side magnet arranged on the substrate side of the first magnet, and an opposite-side magnet arranged on a side opposite to the substrate side of the first magnet, and the first magnet is sandwiched between the substrate-side magnet and the opposite-side magnet.

According to a fourth aspect, in the plating apparatus according to the third aspect, the substrate-side magnet and the opposite-side magnet are arranged so as to exert repulsive magnetic forces on the first magnet, respectively.

According to a fifth aspect, in the plating apparatus according to the third aspect, any one of the substrate-side magnet and the opposite-side magnet is arranged to exert a repulsive magnetic force on the first magnet, and the other magnet of the substrate-side magnet and the opposite-side magnet is arranged so as to exert a magnetic force attracting the first magnet on the first magnet.

According to a sixth aspect, in the plating apparatus according to the second aspect, the paddle extends from the first end portion to the second end portion, and the second magnet is arranged to face the second end portion of the paddle in an extending direction of the paddle, and configured to exert a magnetic force attracting the first magnet on the first magnet.

According to a seventh aspect, in the plating apparatus according to any one of the first to sixth aspects, the paddle has a grid portion extending from the first end portion to the second end portion, and the grid portion has at least a surface that is neither perpendicular nor parallel to a moving direction of the paddle.

According to an eighth aspect, a plating method for plating a substrate is provided. The plating method includes a step of accommodating a substrate and an anode in a plating bath; a step of supporting a first end portion of a paddle; a step of providing a first magnet to the paddle; a step of providing a second magnet to the plating bath; a step of moving the paddle in a reciprocating direction along a surface of the substrate to stir plating solution stored in the plating bath; and a step of exerting a magnetic force on the first magnet by the second magnet so that a second end portion on an opposite side to the first end portion of the paddle is suppressed from vibrating in directions approaching and leaving the substrate while the paddle moves.

According to a ninth aspect, in the plating method according to the eighth aspect, the step of providing the first magnet includes a step of providing the first magnet to the second end portion of the paddle.

According to a tenth aspect, in the plating method according to the eighth or ninth aspect, the step of providing the second magnet includes a step of arranging a substrate-side magnet on a substrate side of the first magnet, and arranging an opposite-side magnet on an opposite side to the substrate side of the first magnet so as to sandwich the first magnet between the substrate-side magnet and the opposite-side magnet.

According to an eleventh aspect, in the plating method according to the tenth aspect, the step of providing the second magnet includes a step of arranging the substrate-side magnet and the opposite-side magnet so that each of the substrate-side magnet and the opposite-side magnet exerts a repulsive magnetic force on the first magnet.

According to a twelfth aspect, in the plating method according to the tenth aspect, the step of providing the second magnet includes a step of arranging the substrate-side magnet and the opposite-side magnet such that any one of the substrate-side magnet and the opposite-side magnet exerts a magnetic force repulsing the first magnet on the first magnet, and the other magnet of the substrate-side magnet and the opposite-side magnet exerts a magnetic force attracting the first magnet on the first magnet.

According to a thirteenth aspect, in the plating method according to the ninth aspect, the paddle extends from the first end portion to the second end portion, and the step of providing the second magnet includes a step of arranging the second magnet so that the second magnet faces the second end portion of the paddle in an extending direction of the paddle so as to exert a magnetic force attracting the first magnet on the first magnet.

According to a fourteenth aspect, in the plating method according to any one of the eighth to thirteenth aspects, the paddle has a grid portion extending from the first end portion to the second end portion, and the grid portion has at least a surface that is neither perpendicular nor parallel to a movement direction of the paddle.

REFERENCE SIGNS LIST

Q . . . plating solution
W . . . substrate
14 . . . plating bath
16 . . . paddle
16*a* . . . elongated hole
16*b* . . . grid portion
17 . . . upper end portion
18 . . . lower end portion
26 . . . anode
38 . . . shaft
60 . . . paddle magnet
70 . . . guide magnet
70*a* . . . substrate-side magnet
70*b* . . . opposite-side magnet

What is claimed is:

1. A plating apparatus for plating a substrate comprising:
a plating bath configured to accommodate plating solution;
a paddle that is arranged in the plating bath, and configured to move in a reciprocating direction along a surface of the substrate to stir the plating solution;
a support member for supporting a first end portion of the paddle;
a first magnet provided on the paddle; and
a second magnet provided on the plating bath, wherein
the first magnet and the second magnet are configured to exert a magnetic force on each other so that a second end portion on an opposite side to the first end portion of the paddle is suppressed from vibrating in directions approaching and leaving the substrate while the paddle is moving,
the second magnet includes a substrate-side magnet arranged on the substrate side of the first magnet, and an opposite-side magnet arranged on a side opposite to the substrate side of the first magnet,
the first magnet is sandwiched between the substrate-side magnet and the opposite-side magnet,
a first pole of the first magnet faces the substrate-side magnet, a second pole of the first magnet faces the opposite-side magnet, and
the substrate-side magnet and the opposite-side magnet are arranged so as to exert repulsive magnetic forces on the first magnet, respectively.

2. The plating apparatus according to claim 1, wherein
the first magnet is provided on the second end portion of the paddle.

3. The plating apparatus according to claim 2, wherein
the paddle extends from the first end portion to the second end portion, and
the second magnet is arranged to face the second end portion of the paddle in an extending direction of the paddle, and configured to exert a magnetic force attracting the first magnet on the first magnet.

4. The plating apparatus according to claim 1, wherein
the paddle has a grid portion extending from the first end portion to the second end portion, and
the grid portion has at least a surface that is neither perpendicular nor parallel to a moving direction of the paddle.

5. A plating apparatus for plating a substrate comprising:
a plating bath configured to accommodate plating solution;

a paddle that is arranged in the plating bath, and configured to move in a reciprocating direction along a surface of the substrate to stir the plating solution;

a support member for supporting a first end portion of the paddle;

a first magnet provided on the paddle; and a second magnet provided on the plating bath, wherein the first magnet and the second magnet are configured to exert a magnetic force on each other so that a second end portion on an opposite side to the first end portion of the paddle is suppressed from vibrating in directions approaching and leaving the substrate while the paddle is moving, the second magnet includes a substrate-side magnet arranged on the substrate side of the first magnet, and an opposite-side magnet arranged on a side opposite to the substrate side of the first magnet, the first magnet is sandwiched between the substrate-side magnet and the opposite-side magnet, any one of the substrate-side magnet and the opposite-side magnet is arranged so as to exert a repulsive magnetic force on the first magnet, and the other magnet of the substrate-side magnet and the opposite-side magnet is arranged so as to exert a magnetic force attracting the first magnet on the first magnet.

* * * * *